US011326788B2

(12) United States Patent
Sawada et al.

(10) Patent No.: US 11,326,788 B2
(45) Date of Patent: May 10, 2022

(54) AIR-CONDITIONING APPARATUS

(71) Applicant: Mitsubishi Electric Corporation, Tokyo (JP)

(72) Inventors: Kazunari Sawada, Tokyo (JP); Taro Hattori, Tokyo (JP); Kazutaka Suzuki, Tokyo (JP); Hirokazu Minamisako, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/965,384

(22) PCT Filed: Feb. 28, 2018

(86) PCT No.: PCT/JP2018/007505
§ 371 (c)(1),
(2) Date: Jul. 28, 2020

(87) PCT Pub. No.: WO2019/167168
PCT Pub. Date: Sep. 6, 2019

(65) Prior Publication Data

US 2021/0156575 A1 May 27, 2021

(51) Int. Cl.

| | |
|---|---|
| ***F24F 1/32*** | (2011.01) |
| ***F24F 1/0063*** | (2019.01) |
| ***F24F 1/16*** | (2011.01) |
| ***F24F 1/62*** | (2011.01) |

(52) U.S. Cl.
CPC ..... *F24F 1/32* (2013.01); *F24F 1/0063* (2019.02); *F24F 1/16* (2013.01); *F24F 1/62* (2013.01)

(58) Field of Classification Search
CPC ..... F24F 1/62; F24F 5/00; F24F 1/16; F24F 1/0063; F24F 1/32; F25B 7/00
See application file for complete search history.

(56) References Cited

U.S. PATENT DOCUMENTS 5,979,782 A * 11/1999 Elwart ..... F24B 1/187 237/16
2012/0292006 A1 11/2012 Yamashita et al.
2013/0233006 A1 9/2013 Morimoto et al.
(Continued)

FOREIGN PATENT DOCUMENTS

EP 2963359 A1 1/2016
EP 3101351 A1 * 12/2016 ..... F24D 3/18
(Continued)

OTHER PUBLICATIONS

JPH11270881A Translation (Year: 1999).*
(Continued)

*Primary Examiner* — Schyler S Sanks
(74) *Attorney, Agent, or Firm* — Posz Law Group, PLC

(57) ABSTRACT

An air-conditioning apparatus includes an outdoor unit, a heat medium relay unit, and an indoor unit. The outdoor unit is installed in an outdoor space, which is a space outside a building including an air-conditioned space. The heat medium relay unit is installed in the outdoor space, and includes a housing that accommodates an intermediate heat exchanger. The indoor unit includes a load heat exchanger configured to exchange heat between air and a heat medium. The housing is installed to the outer wall of the building.

14 Claims, 8 Drawing Sheets

(56) References Cited

U.S. PATENT DOCUMENTS

| | | | | |
|---|---|---|---|---|
| 2014/0196483 | A1 | 7/2014 | Okazaki | |
| 2015/0322672 | A1* | 11/2015 | Deivasigamani | H02G 3/22 52/27 |

FOREIGN PATENT DOCUMENTS

| | | | | |
|---|---|---|---|---|
| EP | 3101351 | A1 | | 12/2016 |
| JP | S53-057648 | U | | 5/1978 |
| JP | S56-060015 | U | | 5/1981 |
| JP | S61-101329 | U | | 6/1986 |
| JP | H03-087128 | U | | 9/1991 |
| JP | H0387128 | U | * | 9/1991 |
| JP | H05-149594 | A | | 6/1993 |
| JP | H05-322224 | A | | 12/1993 |
| JP | H11-270881 | A | | 10/1999 |
| JP | H11270881 | A | * | 10/1999 |
| JP | 2002-340355 | A | | 11/2002 |
| JP | 2011-021837 | A | | 2/2011 |
| JP | 2012-013358 | A | | 1/2012 |
| JP | 2013-088109 | A | | 5/2013 |
| JP | 2013088109 | A | * | 5/2013 |
| JP | 2013-167398 | A | | 8/2013 |
| JP | 2015-163834 | A | | 9/2015 |
| JP | 2016-099093 | A | | 5/2016 |
| WO | 2011/099065 | A1 | | 8/2011 |
| WO | 2012/101673 | A1 | | 8/2012 |
| WO | 2013/038577 | A1 | | 3/2013 |
| WO | 2014/132378 | A1 | | 9/2014 |

OTHER PUBLICATIONS

Extended European Search Report dated Feb. 9, 2021, issued in corresponding European Patent Application No. 18907943.7.

International Search Report of the International Searching Authority dated May 6, 2018 for the corresponding International application No. PCT/JP2018/007505 (and English translation).

Japanese Office Action dated Apr. 6, 2021, issued in corresponding JP Patent Application No. 2020-503161 (and English Machine Translation).

Chinese Office Action dated Apr. 13, 2021, issued in corresponding CN Patent Application No. 201880089896.1 (and English Machine Translation).

Office Action dated Oct. 19, 2021 issued in corresponding CN patent application No. 201880089896.1 (and Machine Translation).

Decision of Rejection dated Feb. 25, 2022 issued in corresponding CN patent application No. 201880089896.1 (and Machine Translation).

* cited by examiner

AIR-CONDITIONING APPARATUS

CROSS REFERENCE TO RELATED APPLICATION

This application is a U.S. national stage application of International Application No. PCT/JP2018/007505, filed on Feb. 28, 2018, the contents of which are incorporated herein by reference.

TECHNICAL FIELD

The present disclosure relates to an air-conditioning apparatus including an intermediate heat exchanger that causes heat exchange to be performed between refrigerant and a heat medium.

BACKGROUND

Hitherto, a heat pump air-conditioning apparatuses that provides cooling, heating, or other such air-conditioning by use of heat taken from outside air by a heat pump that circulates refrigerant is known (see, for example, Patent Literature 1). An air-conditioning apparatus described in Patent Literature 1 includes an outdoor unit, an indoor unit, and a heat medium relay unit including an intermediate heat exchanger.

In such air-conditioning apparatuses, the outdoor unit and the heat medium relay unit are connected in series by a pipe to form a refrigerant circuit in which refrigerant circulates, and the indoor unit and the heat medium relay unit are connected in series to form a heat medium circuit in which a heat medium circulates. The indoor unit is disposed in an interior space, such as a space inside a room where a person resides, and the outdoor unit is disposed in an outdoor space, which is a space outside a building or other such structure. With related-art air-conditioning apparatuses, the heat medium relay unit is disposed in an indoor space such as a space above a ceiling to avoid freezing of the heat medium.

The pressure within the refrigerant circuit is higher than the pressure within the heat medium circuit. Thus, if the intermediate heat exchanger is damaged, and refrigerant circulating in the refrigerant circuit leaks toward the heat medium circuit, the refrigerant flows into the indoor unit disposed in the interior space. To address this issue, the heat medium circuit described in Patent Literature 1 is provided with a relief valve that, upon entry of refrigerant into the heat medium circuit, activates to discharge the refrigerant and the heat medium to the inside of the heat medium relay unit.

PATENT LITERATURE

Patent Literature 1: Japanese Unexamined Patent Application Publication No. 5-322224

The increasing demand for curbing global warming and ozone depletion has led to a shift toward refrigerants such as R32 or propane gas with reduced global warming potential and reduced ozone depletion potential. These refrigerants are flammable. Thus, from the safety and other viewpoints, it is necessary to reduce leakage of refrigerant not only to the interior space but also to other indoor spaces such as a space above a ceiling. In this regard, the configuration according to Patent Literature 1 can neither prevent leakage of refrigerant into the indoor space nor prevent the entry of refrigerant leaking from the heat medium relay unit into the interior space. Therefore, it is desirable to install the heat medium relay unit outdoors.

It is to be noted, however, that if the heat medium relay unit is installed outdoors in a conventional manner, the pipe of the heat medium circuit that connects the indoor unit with the heat medium circuit is exposed outdoors and thus contacts outside air. Consequently, in winter when outside air is cold, in particular, the heat medium flowing in the heat medium circuit freezes, resulting in poor circulation of the heat medium. Further, in cold climate areas, the heat medium freezes frequently, leading to increased frequency of failures resulting from such poor circulation of the heat medium.

SUMMARY

The present disclosure has been made to address the above-mentioned problem, and accordingly it is an object of the disclosure to provide an air-conditioning apparatus that reduces leakage of refrigerant into the indoor space, and also prevents freezing of a heat medium flowing in a heat medium circuit.

An air-conditioning apparatus according to an embodiment of the present disclosure includes an outdoor unit, a heat medium relay unit, and an indoor unit. The outdoor unit is installed in an outdoor space, and includes a heat-source heat exchanger configured to cause heat between to be performed between outside air and refrigerant, the outdoor space being a space outside a building including an air-conditioned space. The heat medium relay unit is installed in the outdoor space, and includes an intermediate heat exchanger and a housing, the intermediate heat exchanger being configured to cause heat exchange to be performed between a heat medium and the refrigerant, the housing being configured to accommodate the intermediate heat exchanger. The indoor unit includes a load heat exchanger configured to cause heat exchange to be performed between air in the air-conditioned space and the heat medium. The housing is installed to the outer wall of the building.

According to an embodiment of the present disclosure, the heat medium relay unit is installed to the outer wall of the building. This makes it possible to reduce the entry of refrigerant into the indoor space when the intermediate heat exchanger is damaged, and also prevent the heat medium pipe from being exposed outdoors. As a result, leakage of refrigerant into the indoor space can be reduced, and also freezing of the heat medium flowing in the heat medium circuit can be prevented.

DESCRIPTION OF EMBODIMENTS

Embodiment

Figure 1:
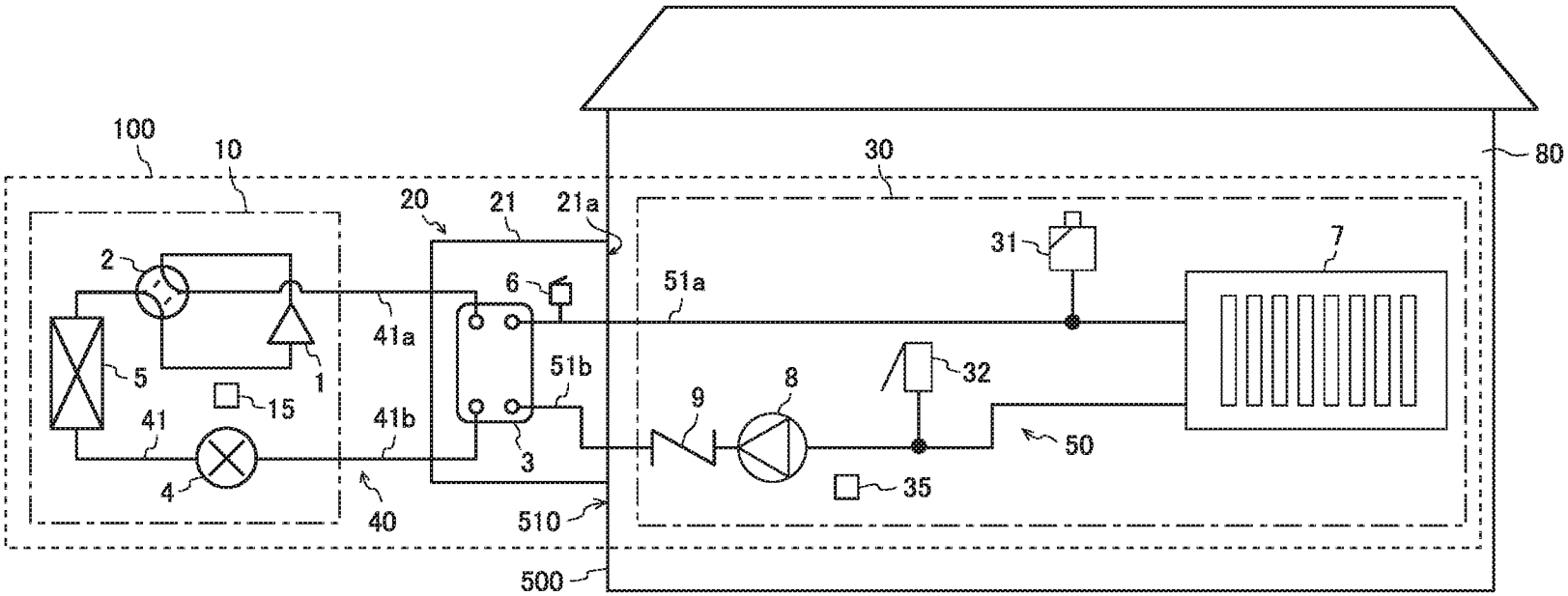
FIG. 1 is a schematic diagram illustrating an exemplary configuration of an air-conditioning apparatus according to Embodiment of the present disclosure.

FIG. 1 is a schematic diagram illustrating an exemplary configuration of an air-conditioning apparatus according to Embodiment of the present disclosure. The general configuration of an air-conditioning apparatus 100 according to Embodiment will be described below with reference to FIG. 1. The air-conditioning apparatus 100 performs an operation such as heating or cooling to provide air conditioning to an air-conditioned space 80. If frost forms on a heat-source heat exchanger 5 due to heating operation, the air-conditioning apparatus 100 performs a defrost operation to remove the frost on the heat-source heat exchanger 5.

The air-conditioning apparatus 100 includes the following components: an outdoor unit 10 installed in an outdoor space, which is a space outside a building 500 including the air-conditioned space 80; a heat medium relay unit 20 that is likewise installed in the outdoor space; and an indoor unit 30 installed in an indoor space, which is a space inside the building 500. At least a portion of the indoor unit 30 is disposed in the interior of the air-conditioned space 80. The air-conditioned space 80 refers to an indoor space to be air-conditioned by the air-conditioning apparatus 100. Hereinafter, the interior of the air-conditioned space 80 will be also referred to as interior space.

As illustrated in FIG. 1, the outdoor unit 10 includes a compressor 1, a four-way valve 2, the heat-source heat exchanger 5, and an expansion valve 4. The heat medium relay unit 20 includes a box-shaped housing 21, and also an intermediate heat exchanger 3 and a pressure relief device 6. The intermediate heat exchanger 3 and the pressure relief device 6 are accommodated in the housing 21. The housing 21, which defines the exterior of the heat medium relay unit 20, is made of a material such as a sheet metal. The housing 21 is installed to an outer wall 510 of the building 500. The indoor unit 30 includes a load heat exchanger 7, a pump 8, and a check valve 9.

The outdoor unit 10 includes an outdoor control device 15 that controls how the compressor 1 and the four-way valve 2 operate. The indoor unit 30 includes an indoor control device 35 that controls how the pump 8 operates. The air-conditioning apparatus 100 provides air conditioning to the air-conditioned space 80 through coordinated operation of the outdoor control device 15 and the indoor control device 35.

The air-conditioning apparatus 100 includes a refrigerant circuit 40 in which refrigerant circulates. The refrigerant circuit 40 is formed by connecting the compressor 1, the four-way valve 2, the heat-source heat exchanger 5, the expansion valve 4, and the intermediate heat exchanger 3 by a refrigerant pipe 41. In this regard, the refrigerant pipe 41 that connects the intermediate heat exchanger 3 and the four-way valve 2 will be referred to as refrigerant pipe 41*a*, and the refrigerant pipe 41 that connects the intermediate heat exchanger 3 and the expansion valve 4 will be referred to as refrigerant pipe 41*b*. In Embodiment, it is presumed that a flammable refrigerant such as R32 or propane circulates in the refrigerant circuit 40.

The air-conditioning apparatus 100 includes a heat medium circuit 50 in which a heat medium circulates. The heat medium circuit 50 is formed by connecting the intermediate heat exchanger 3, the pressure relief device 6, the load heat exchanger 7, the pump 8, and the check valve 9 by a heat medium pipe 51. In other words, the intermediate heat exchanger 3 and the load heat exchanger 7 are connected by the heat medium pipe 51 to form the heat medium circuit 50. Thus, in the indoor unit 30, the heat medium that has undergone heat exchange in the intermediate heat exchanger 3 is routed into the interior space. In this regard, the heat medium pipe 51 that connects the intermediate heat exchanger 3 and the load heat exchanger 7 will be referred to as heat medium pipe 51*a*, and the heat medium pipe 51 that connects the intermediate heat exchanger 3 and the check valve 9 will be referred to as heat medium pipe 51*b*. A medium such as water or brine can be used as the heat medium circulating in the heat medium circuit 50.

The compressor 1 is driven by, for example, an inverter to compress refrigerant. The four-way valve 2 is connected to the compressor 1. The four-way valve 2 is controlled by the outdoor control device 15 to switch the directions of refrigerant flow. During heating operation in which heating energy is supplied to the indoor unit 30, the flow passages of the four-way valve 2 are switched by the outdoor control device 15 such that refrigerant flows through the four-way valve 2 as represented by solid lines in FIG. 1. During cooling operation in which cooling energy is supplied to the indoor unit 30, the flow passages of the four-way valve 2 are switched by the outdoor control device 15 such that refrigerant flows through the four-way valve 2 as represented by dashed lines in FIG. 1. The heat-source heat exchanger 5 is, for example, a fin-and-tube heat exchanger. The heat-source heat exchanger 5 exchanges cause heat exchange to be performed between refrigerant flowing in the refrigerant circuit 40, and outside air. The expansion valve 4 is, for example, an electronic expansion valve. The expansion valve 4 reduces the pressure of refrigerant, thus causing the refrigerant to expand.

The intermediate heat exchanger 3 is, for example, a plate heat exchanger. The intermediate heat exchanger 3 causes heat exchange to be performed between refrigerant circulating in the refrigerant circuit 40, and a heat medium circulating in the heat medium circuit 50. The load heat exchanger 7 is installed in the air-conditioned space 80. The load heat exchanger 7 is, for example, a fin-and-tube heat exchanger. The load heat exchanger 7 exchanges heat between a heat medium flowing in the heat medium circuit 50, and the air in the interior space.

The pump 8 applies a pressure for causing a heat medium to circulate in the heat medium circuit 50. The pump 8 includes a motor (not illustrated) driven by an inverter. The pump 8 is driven with the motor serving as a power source. The check valve 9 allows a fluid to pass only in the forward direction, and automatically closes when a fluid attempts to flow in the reverse direction. In Embodiment, the check valve 9 is mounted such that the direction from the pump 8 toward the intermediate heat exchanger 3 serves as the forward direction.

The pressure relief device 6 is mounted at a location where the heat medium circuit 50 communicating with the interior space branches off inside the heat medium relay unit 20. In other words, the pressure relief device 6 is installed such that the pressure relief device 6 is branched off from a portion of the heat medium pipe 51*a* disposed inside the housing 21. If the pressure within the heat medium circuit 50 rises to a pressure threshold, the pressure relief device 6 discharges the heat medium out of the heat medium circuit 50 to thereby adjust the pressure within the heat medium circuit 50. In this regard, the pressure threshold is a value determined by the configuration of the pressure relief device 6. In Embodiment, a pressure within the heat medium circuit 50 that is below the pressure threshold is used as an indicator of the normal condition of the air-conditioning apparatus 100.

More specifically, the pressure relief device 6 includes a spring, a valve, and a valve seat. The exterior of the pressure relief device 6 has an inlet, which is an opening located near the heat medium pipe 51, and an outlet through which the heat medium is discharged out of the heat medium circuit 50. The valve seat is disposed at the inlet. The valve seat is open on the side near the heat medium pipe 51 and on the side near the valve.

In the pressure relief device 6, the elasticity of the spring keeps the valve in contact with the valve seat when the pressure within the heat medium circuit 50 is below a pressure threshold. In other words, in this state, the opening in the valve seat is closed by the valve, and thus the heat medium is not released to the outside of the heat medium circuit 50. When the pressure within the heat medium circuit 50 is larger than or equal to the pressure threshold, the pressure with which the heat medium presses against the valve overcomes the elasticity of the spring, and a gap forms between the valve seat and the valve. The heat medium is thus released from the outlet to the outside of the heat medium circuit 50.

The indoor unit 30 includes an air vent valve 31, and a load safety valve 32. The air vent valve 31 is used to discharge the air within the heat medium circuit 50 to adjust the pressure within the heat medium circuit 50. To enable efficient discharge of air, the air vent valve 31 is provided to the heat medium pipe 51 located at the highest position. In the example illustrated in FIG. 1, the air vent valve 31 is provided to a pipe branched off from a point along the heat medium pipe 51*a*. In this regard, the air vent valve 31 may be disposed outside the indoor unit 30 as long as the air vent valve 31 is located inside the air-conditioned space 80.

The load safety valve 32 is used to discharge the heat medium flowing in the heat medium circuit 50 to the outside when the pressure within the heat medium circuit 50 rises to a predetermined pressure. To make the load safety valve 32 less susceptible to the influence of the pressure rise due to the pump 8, the load safety valve 32 is provided to a pipe branched off from near the inlet of the pump 8. Thus, the load safety valve 32 is installed in the air-conditioned space 80. In this regard, the air vent valve 31 and the load safety valve 32 may be disposed outside the indoor unit 30 as long as these valves are located inside the air-conditioned space 80.

Figure 2:
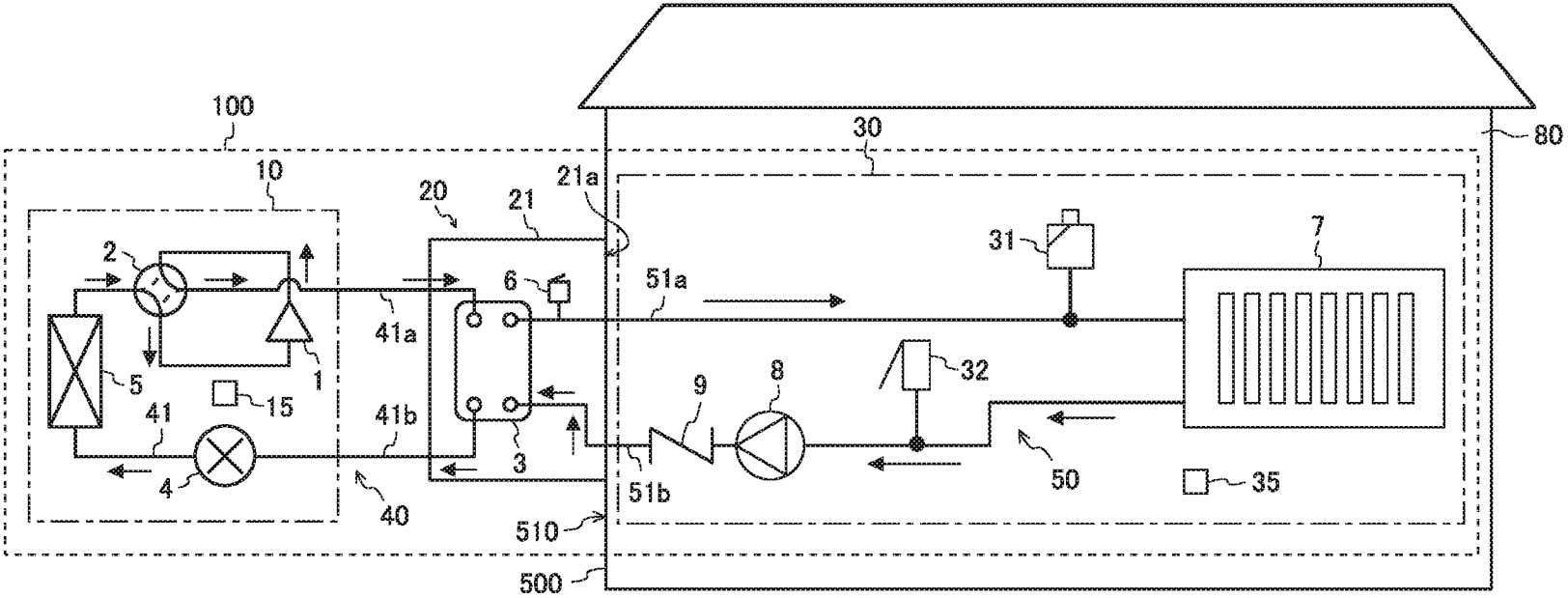
FIG. 2 illustrates how refrigerant and a heat medium flow during heating operation of the air-conditioning apparatus illustrated in FIG. 1.

FIG. 2 illustrates how refrigerant and a heat medium flow during heating operation of the air-conditioning apparatus illustrated in FIG. 1. During heating operation, in the refrigerant circuit 40, refrigerant raised to a high temperature and a high pressure by the compressor 1 passes through the four-way valve 2 into the intermediate heat exchanger 3. Upon entering the intermediate heat exchanger 3, the refrigerant turns into liquid refrigerant in heat exchange with the heat medium circulating in the heat medium circuit 50. At this time, the heat medium circulating in the heat medium circuit 50 is heated by the refrigerant entering the intermediate heat exchanger 3. After leaving the intermediate heat exchanger 3, the liquid refrigerant passes through the expansion valve 4 and thus expands, causing the liquid refrigerant to turn into two-phase gas-liquid refrigerant at low temperature and low pressure. After leaving the expansion valve 4, the two-phase gas-liquid refrigerant flows into the heat-source heat exchanger 5, where the two-phase gas-liquid refrigerant exchanges heat with outside air and thus evaporates into gas refrigerant. After leaving the heat-source heat exchanger 5, the gas refrigerant is again passed through the four-way valve 2 and sucked into the compressor 1 where the gas refrigerant turns into high-temperature and high-pressure refrigerant.

During heating operation, in the heat medium circuit 50, a heat medium heated to a high temperature in the intermediate heat exchanger 3 passes through the pressure relief device 6 into the load heat exchanger 7. In this regard, the pressure relief device 6 is designed such that when the pressure within the heat medium circuit 50 is larger than or equal to a pressure threshold, a gap is formed between the valve seat and the valve, and the heat medium is thus released to the outside of the heat medium circuit 50. Accordingly, as long as the air-conditioning apparatus 100 is operating in normal condition, the pressure within the heat medium circuit 50 does not rise to or above the pressure threshold, and thus the heat medium is not released to the outside of the heat medium circuit 50. The heat medium at high temperature entering the load heat exchanger 7 is cooled in heat exchange with the air in the interior space. At this time, the air in the interior space is heated by the heat medium entering the load heat exchanger 7. The heat medium cooled in the load heat exchanger 7 passes through the pump 8 and the check valve 9 in this order, and flows into the intermediate heat exchanger 3 again.

Figure 3:
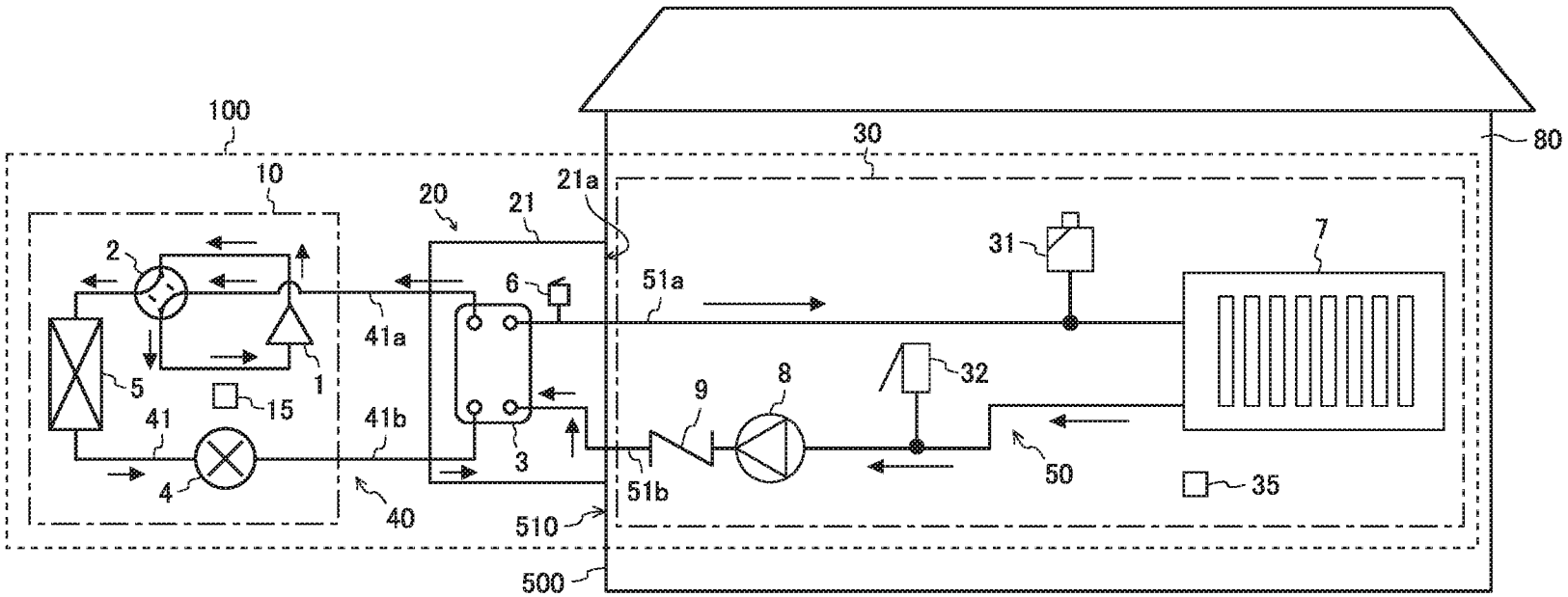
FIG. 3 illustrates how refrigerant and a heat medium flow during cooling operation of the air-conditioning apparatus illustrated in FIG. 1.

FIG. 3 illustrates how refrigerant and a heat medium flow during cooling operation of the air-conditioning apparatus illustrated in FIG. 1. During cooling operation, in the refrigerant circuit 40, refrigerant raised to a high temperature and a high pressure by the compressor 1 passes through the four-way valve 2 into the heat-source heat exchanger 5. Upon entering the heat-source heat exchanger 5, the refrigerant turns into liquid refrigerant in heat exchange with outside air. After leaving the heat-source heat exchanger 5, the liquid refrigerant passes through the expansion valve 4 and thus expands, causing the liquid refrigerant to turn into two-phase gas-liquid refrigerant at low temperature and low pressure. After leaving the expansion valve 4, the two-phase gas-liquid refrigerant flows into the intermediate heat exchanger 3, where the two-phase gas-liquid refrigerant exchanges heat with the heat medium circulating in the heat medium circuit 50 and thus evaporates into gas refrigerant. At this time, the heat medium circulating in the heat medium circuit 50 is cooled by the refrigerant entering the intermediate heat exchanger 3. After leaving the intermediate heat exchanger 3, the gas refrigerant is again passed through the four-way valve 2 and sucked into the compressor 1 where the gas refrigerant turns into high-temperature and high-pressure refrigerant.

During cooling operation, in the heat medium circuit 50, a heat medium cooled to a low temperature in the intermediate heat exchanger 3 passes through the pressure relief device 6 into the load heat exchanger 7. At this time, the pressure relief device 6 operates in the same manner as during heating operation. That is, when the pressure within the heat medium circuit 50 is larger than or equal to a pressure threshold, a flow path directed from the inlet toward the outlet is created in the pressure relief device 6. Thus, the heat medium entering through the inlet exits through the outlet. The heat medium at high temperature entering the load heat exchanger 7 is heated in heat exchange with the air in the interior space. At this time, the air in the interior space is cooled by the heat medium entering the load heat exchanger 7. The heat medium heated in the load heat exchanger 7 passes through the pump 8 and the check valve 9 in this order, and flows into the intermediate heat exchanger 3 again.

During defrost operation of the air-conditioning apparatus 100, the refrigerant and the heat medium flow in the same manner as during cooling operation. That is, if frost forms on the heat-source heat exchanger 5 due to heating operation, the outdoor control device 15 and the indoor control device 35 control operation of each actuator in the same manner as during cooling operation to execute a defrost operation.

As described above, during cooling operation or defrost operation, low-temperature refrigerant flows into the intermediate heat exchanger 3 and cools the heat medium flowing in the intermediate heat exchanger 3. The heat medium flowing in the intermediate heat exchanger 3 may thus freeze, and the resulting volume expansion of the heat medium may damage the intermediate heat exchanger 3. Further, the intermediate heat exchanger 3 may suffer from damage due to an abnormal increase in refrigerant pressure, or may suffer from fatigue fracture or damage due to repeated increases in pressure. Further, if the plate between the refrigerant layer and the heat medium layer in the intermediate heat exchanger 3 corrodes, thinning of the plate due to the corrosion may cause a decrease in strength and consequently exacerbate the above-mentioned damage.

If the intermediate heat exchanger 3 is damaged, refrigerant enters the heat medium circuit 50 due to the difference in pressure between the refrigerant flowing in the refrigerant circuit 40 and the heat medium flowing in the heat medium circuit 50. As the refrigerant enters the heat medium circuit 50, the refrigerant undergoes a decrease in pressure and thus gasifies. This causes a rise in the pressure within the heat medium circuit 50.

Now, presuming that the heat medium relay unit 20 is not provided with the pressure relief device 6, when the pressure within the heat medium circuit 50 rises, the heat medium is discharged to the interior space by the load safety valve 32 incorporated in the heat medium circuit 50. At this time, the refrigerant entering the heat medium circuit 50 is discharged together with the heat medium, and this may cause a flammable region to be formed in the interior space. Similarly, the refrigerant that has gasified upon entry into the heat medium circuit 50 is discharged by the air vent valve 31, and this may cause a flammable region to form in the interior space.

In this regard, the air-conditioning apparatus 100 according to Embodiment includes the pressure relief device 6 disposed in the heat medium relay unit 20. Accordingly, when the pressure within the heat medium circuit 50 rises, the pressure relief device 6 installed in the heat medium relay unit 20 located outdoors activates to release the heat medium and the refrigerant to the outdoor space. This helps to prevent the risk that refrigerant entering through a damaged portion of the intermediate heat exchanger 3 may reach the indoor space and form a flammable region.

Figure 4:
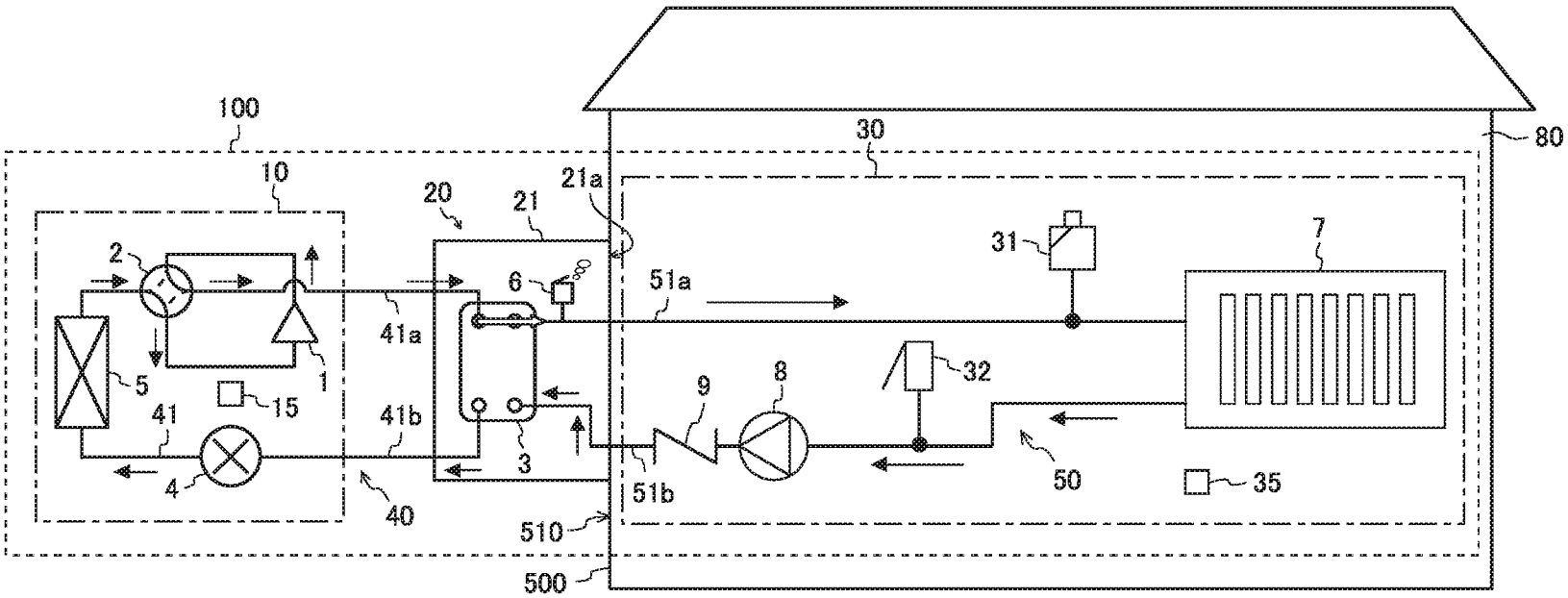
FIG. 4 illustrates how refrigerant and water flow if refrigerant leaks from an intermediate heat exchanger illustrated in FIG. 1 to a heat medium circuit.

FIG. 4 illustrates how refrigerant and water flow if refrigerant leaks in the intermediate heat exchanger illustrated in FIG. 1 to the heat medium circuit. With reference to FIG. 4, the following describes how the pressure relief device 6 operates when refrigerant leaks from the intermediate heat exchanger 3 to the heat medium circuit 50 during cooling operation.

If refrigerant leaks from the intermediate heat exchanger 3 to the heat medium circuit 50, the refrigerant enters the heat medium circuit 50 because the pressure within the refrigerant circuit 40 is higher than the pressure within the heat medium circuit 50. Then, the entering refrigerant causes an abrupt rise in pressure within the heat medium circuit 50. When the pressure within the heat medium circuit 50 rises and reaches a pressure threshold, the pressure relief device 6 installed in the heat medium relay unit 20 located outdoors activates to release the heat medium and the refrigerant to the outdoor space. The pressure relief device 6 operates in the same manner as described above also during cooling operation and defrost operation.

With the air-conditioning apparatus 100, the pressure relief device 6 operates as described above. This helps to ensure not only that refrigerant entering through a damaged portion of the intermediate heat exchanger 3 does not enter the interior space, but also that such refrigerant does not enter other indoor spaces such as a space above a ceiling. Therefore, refrigerant entering through a damaged portion of the intermediate heat exchanger 3 can be prevented from forming a flammable region in the indoor space, leading to increased safety.

Figure 5:
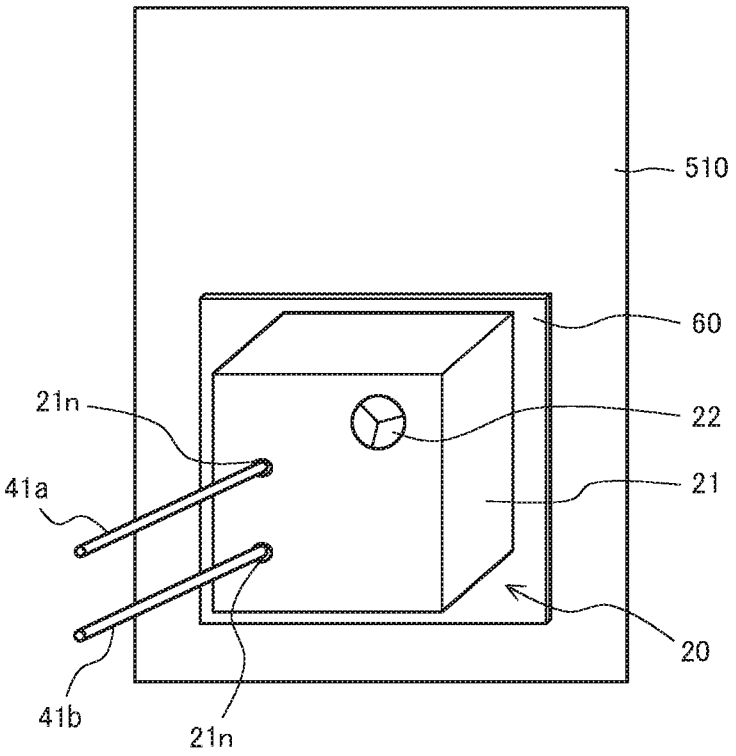
FIG. 5 is a perspective view of a heat medium relay unit illustrated in FIG. 1, illustrating an exemplary installation of the heat medium relay unit.
Figure 6:
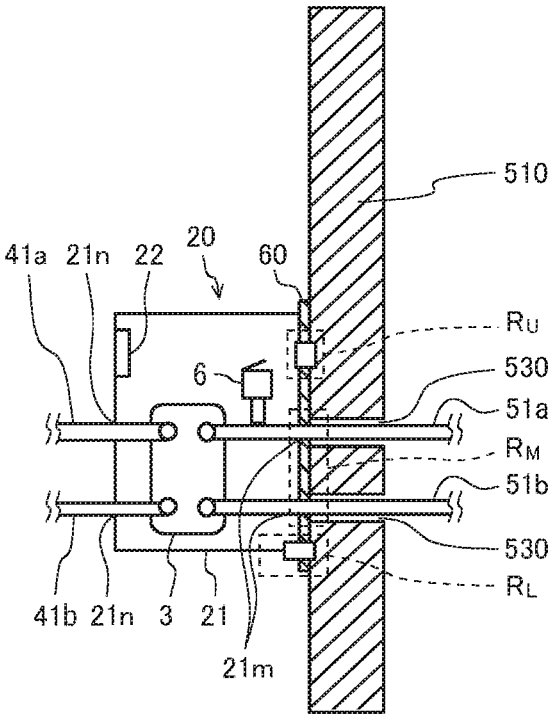
FIG. 6 is a schematic cross-sectional view of the heat medium relay unit illustrated in FIG. 1, illustrating an exemplary installation of the heat medium relay unit.

FIG. 5 is a perspective view of the heat medium relay unit illustrated in FIG. 1, illustrating an exemplary installation of the heat medium relay unit. FIG. 6 is a schematic cross-sectional view of the heat medium relay unit illustrated in FIG. 1, illustrating an exemplary installation of the heat medium relay unit. As illustrated in FIGS. 5 and 6, the heat medium relay unit 20 is installed to the outer wall 510 of the building 500 with a mounting component 60 interposed therebetween. In other words, the air-conditioning apparatus 100 includes the mounting component 60 interposed between the housing 21 and the outer wall 510. The mounting component 60 is formed by working a sheet metal or other such material into the mounting component 60.

The heat medium pipes 51*a* and 51*b* project from the heat medium relay unit 20 through a side wall of the housing 21 facing the outer wall 510. In other words, the heat medium pipes 51*a* and 51 *b* connected to the intermediate heat exchanger 3 are each inserted into an opening 21*m* defined in the side wall of the housing 21 facing the outer wall 510. The heat medium pipes 51*a* and 51*b* each communicate with the interior space through a through-hole 530 defined in the outer wall 510. The refrigerant pipes 41*a* and 41*b* connected to the intermediate heat exchanger 3 each communicate with the outdoor space through an opening 21*n* defined in a side wall of the housing 21 opposite to the outer wall 510. The refrigerant pipes 41*a* and 41*b* are connected to the outdoor unit 10.

Accordingly, the height at which the heat medium relay unit 20 is mounted to the outer wall 510 is desirably set such that the joint between each of the refrigerant pipes 41*a* and 41 *b* and the outdoor unit 10 is located at the same height as the joint between each of the refrigerant pipes 41*a* and 41*b* and the intermediate heat exchanger 3. In addition, the height at which to mount the heat medium relay unit 20 to the outer wall 510 is desirably set such that the joint between each of the heat medium pipes 51*a* and 51 *b* and the indoor unit 30 is located at the same height as the joint between each of the heat medium pipes 51*a* and 51*b* and the intermediate heat exchanger 3.

The heat medium relay unit 20 includes a ventilation fan 22 to send the air within the housing 21 to the outside. FIG. 6 depicts an exemplary case in which the ventilation fan 22 is provided to the side wall of the housing 21 opposite to the outer wall 510. Accordingly, if refrigerant enters the heat medium circuit 50, the refrigerant is temporarily released to the inside of the housing 21 by the pressure relief device 6, and the refrigerant released to the inside of the housing 21 is then released into the atmosphere by the ventilation fan 22. In this way, with the air-conditioning apparatus 100, refrigerant discharged from the pressure relief device 6 to the inside of the housing 21 is discharged outdoors by the ventilation fan 22. This makes it possible to avoid formation of a flammable region in the indoor space, leading to increased safety.

Figure 7:
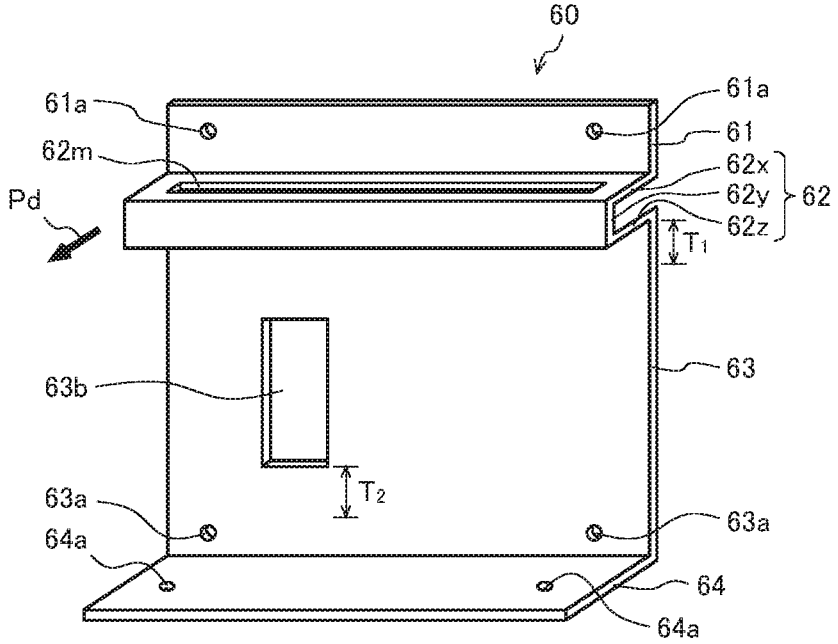
FIG. 7 is a perspective view of a mounting component illustrated in FIGS. 5 and 6, illustrating an exemplary specific shape of the mounting component.

FIG. 7 is a perspective view of the mounting component illustrated in FIGS. 5 and 6, illustrating an exemplary specific shape of the mounting component. As illustrated in FIG. 7, the mounting component 60 according to Embodiment has a fixing part 61 to be fixed to the outer wall 510, and a projection 62 connected to the fixing part 61 and having a cutout 62*m* defined in an upper portion of the projection 62. The projection 62 is formed to have a U-shape in cross-section. The mounting component 60 also has a base part 63 connected to the projection 62 and having a pipe hole 63*b* into which the heat medium pipe 51 is inserted. Further, the mounting component 60 has a support part 64 connected to the base part 63 to support a lower portion of the housing 21.

The fixing part 61 is a plate-like component, and has two screw holes 61*a*. The projection 62 includes an engaging part 62*x*, an abutting part 62*y*, and a lower projecting part 62*z*. The engaging part 62*x* is a plate-like component that is connected to one end portion of the fixing part 61 lying along the length of the fixing part 61, and extends in the perpendicular direction with respect to the fixing part 61. The engaging part 62*x* has the cutout 62*m* defined as a hole into which a hooking part 25*b* of a hook 25 described later is inserted.

The abutting part 62*y* is a plate-like component that is connected to an end portion of the engaging part 62*x* opposite to the fixing part 61, and extends in the perpendicular direction with respect to the engaging part 62*x*. The lower projecting part 62*z* is a plate-like component that is connected to an end portion of the abutting part 62*y* opposite to the engaging part 62*x*, and extends in the perpendicular direction with respect to the abutting part 62*y*.

The base part 63 is a plate-like component that is connected to an end portion of the lower projecting part 62*z* opposite to the abutting part 62*y*, and extends in the perpendicular direction with respect to the lower projecting part 62*z*. The base part 63 has two screw holes 63*a*, and the pipe hole 63*b* into which the heat medium pipes 51*a* and 51*b* are inserted. The support part 64 is a plate-like component that is connected to an end portion of the base part 63 opposite to the lower projecting part 62*z*, and extends in the perpendicular direction with respect to the base part 63. The support part 64 has two screw holes 64*a*.

Figure 8:
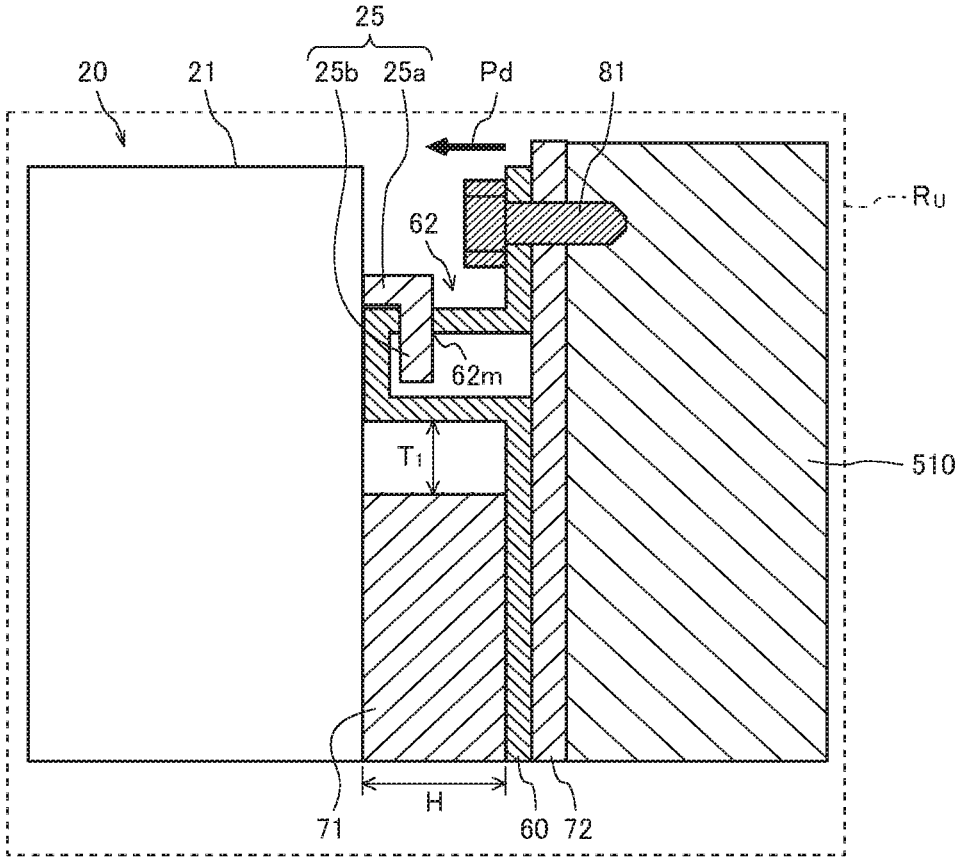
FIG. 8 illustrates an upper mounting area illustrated in FIG. 6 where a heat medium relay unit is mounted to an outer wall.

FIG. 8 illustrates an upper mounting area illustrated in FIG. 6 where the heat medium relay unit is mounted to the outer wall. With reference to FIG. 8, a specific structure of each component located within an upper mounting area Ru will be described. The housing 21 is provided with the hook 25 that has a shape corresponding to the cutout 62*m*. FIG. 8 illustrates an exemplary case in which the hook 25 projects in an inverted L-shape. More specifically, the hook 25 has an extending part 25*a*, which extends perpendicularly from a side wall of the housing 21, and the hooking part 25*b*, which is connected to the extending part 25*a* and inserted into the cutout 62*m*. The hook 25 may be formed integrally with the housing 21, or may be a component that is fixed to the housing 21 with a screw or other such component.

The mounting component 60 is fastened and fixed to the outer wall 510 with a screw 81, which is inserted through each screw hole 61*a* of the fixing part 61. By hooking the hook 25 into the cutout 62*m* in the projection 62 with the mounting component 60 being fixed on the outer wall 510, the position of the heat medium relay unit 20 in the direction of height is restricted.

An outside thermal insulator 71, which is a stretchable thermal insulator, is mounted to a surface of the mounting component 60 facing the heat medium relay unit 20. The outside thermal insulator 71 is capable of expanding or contracting with applied force. More specifically, the outside thermal insulator 71 is affixed to a surface of the base part 63 facing the heat medium relay unit 20.

In the state before the heat medium relay unit 20 is installed to the outer wall 510, the outside thermal insulator 71 has a thickness larger than a projecting height H, which is the height of the projection 62 in a projecting direction Pd in which the projection 62 projects. In this regard, with the mounting component 60 being fixed on the outer wall 510, the projecting direction Pd refers to a direction perpendicular to a surface of the outer wall 510 facing the mounting component 60. In other words, under no applied pressure, the outside thermal insulator 71 has a thickness larger than or equal to the projecting height H of the projection 62. Consequently, in mounting the heat medium relay unit 20, the outside thermal insulator 71 is always compressed, and thus the space between the mounting component 60 and the heat medium relay unit 20 can be filled with the outside thermal insulator 71.

With respect to the direction of width, the outside thermal insulator 71 is affixed over an area equal to the breadth of the mounting component 60. With respect to the direction of height, the outside thermal insulator 71 is affixed over an area extending from a position that is lower than the lower surface of the lower projecting part 62*z* of the projection 62 by an upper set value $T_1$, to a position that is lower than the lower end of the pipe hole 63*b* by a lower set value $T_2$ or more.

The upper set value $T_1$ is set to, for example, about 10 mm to 20 mm. This is to ensure that the projection 62 and the outside thermal insulator 71 do not interfere with each other when the mounting component 60 and the outside thermal insulator 71 undergo thermal deformation associated with fluctuations in outdoor temperature. The lower set value $T_2$ is set to about 50 mm. This is to ensure sufficient thermal insulation of the heat medium pipe 51 passing through the pipe hole 63*b*. It is to be noted, however, that the upper set value $T_1$ and the lower set value $T_2$ may be changed in accordance with the size of the heat medium relay unit 20, the shape of the mounting component 60, or other factors.

As described above, the gap between the heat medium relay unit 20 and the mounting component 60 is covered with the outside thermal insulator 71, thus preventing outdoor air from entering the heat medium relay unit 20 through the gap between the heat medium relay unit 20 and the mounting component 60. This makes it possible to prevent the heat medium within the heat medium pipe 51 from freezing.

The inside thermal insulator 72, which is a stretchable thermal insulator, is mounted to a surface of the mounting component 60 facing the outer wall 510. In Embodiment, the inside thermal insulator 72 is affixed over the entire surface of the mounting component 60 facing the outer wall 510. This makes it possible to eliminate even a slight gap that can be formed between the mounting component 60 and the outer wall 510, thus more effectively preventing freezing of the heat medium pipe 51.

Installing the heat medium relay unit 20 to the outer wall 510 introduces the possibility that vibrations generated from the refrigerant pipe 41, the heat medium pipe 51, and the intermediate heat exchanger 3 propagate through the housing 21 to the interior space as vibration noise. In this regard, if the inside thermal insulator 72 is affixed to the mounting component 60, the inside thermal insulator 72 absorbs such vibrations between the mounting component 60 and the outer wall 510. This makes it possible to reduce vibration noise in the interior space.

Figure 9:
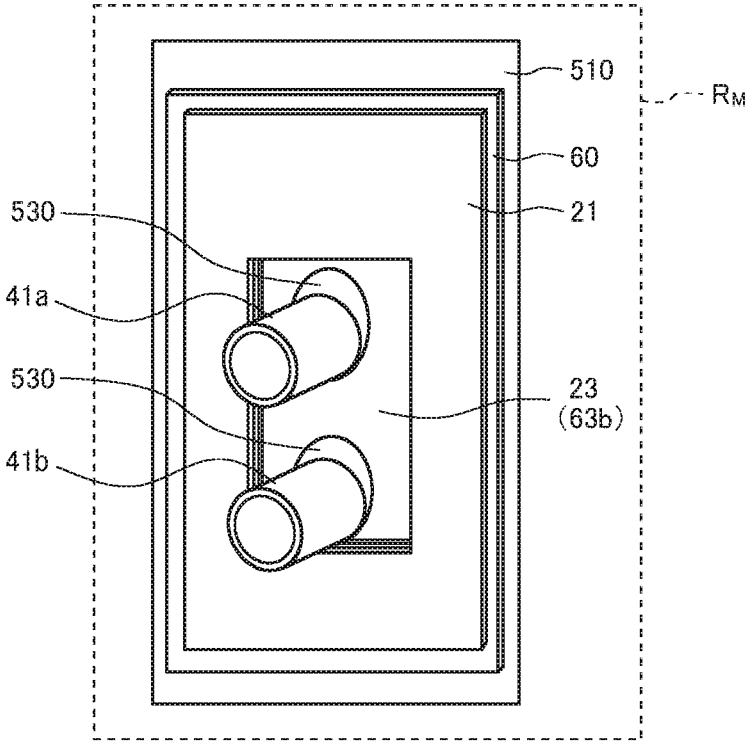
FIG. 9 illustrates the configuration of a pipe vicinity area illustrated in FIG. 6, which is the area in the vicinity of a heat medium pipe that communicates with a heat medium relay unit and with an outer wall.
Figure 10:
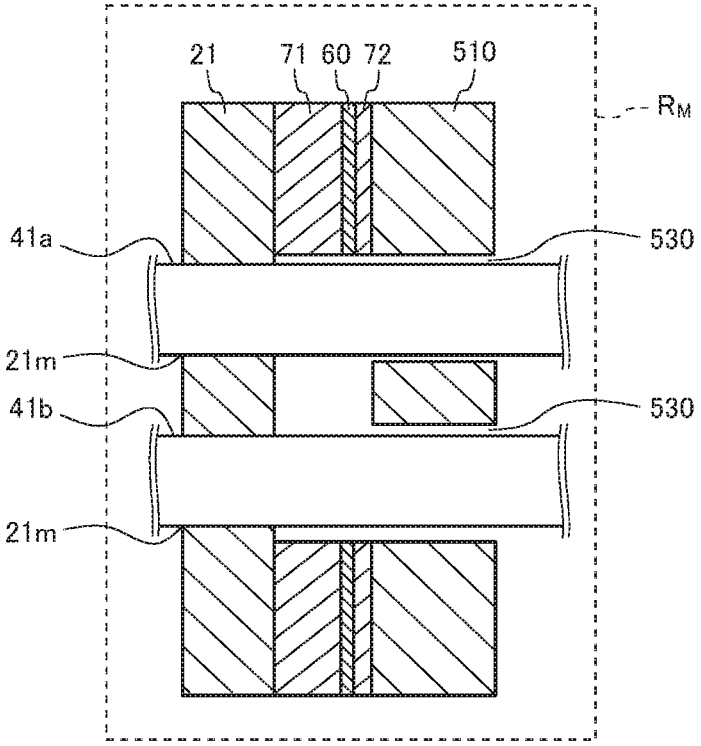
FIG. 10 is a schematic cross-sectional view of the pipe vicinity area illustrated in FIG. 9.

FIG. 9 illustrates the configuration of a pipe vicinity area illustrated in FIG. 6, which is the area in the vicinity of the heat medium pipe that communicates with the heat medium relay unit and with the outer wall. FIG. 10 is a schematic cross-sectional view of the pipe vicinity area illustrated in FIG. 9. With reference to FIGS. 9 and 10, a specific structure of each component located within a pipe vicinity area $R_M$ will be described.

The outer wall 510 has two through-holes 530. The heat medium pipe 51*a* passes through one of the through-holes 530, and the heat medium pipe 51*b* passes through the other through-hole 530. The mounting component 60 has the pipe hole 63*b* having a rectangular shape with an area larger than that of the two through-holes 530. Further, the housing 21 of the heat medium relay unit 20, the outside thermal insulator 71, and the inside thermal insulator 72 each have, at a location corresponding to the pipe hole 63*b*, a rectangular hole having an area larger than that of the two through-holes 530. In other words, an opening 23 illustrated in FIG. 9 is defined by the pipe hole 63*b*, the hole in the housing 21 of the heat medium relay unit 20, the hole in the outside thermal insulator 71, and the hole in the inside thermal insulator 72.

It is to be noted, however, that the opening 23 may not necessarily have a rectangular shape but may have another shape as long as the opening 23 has an area larger than the area occupied by the two through-holes 530 and allows the two through-holes 530 to fit within the opening 23. Alternatively, two openings 23 may be provided, one corresponding to one through-hole 530 and the other corresponding to the other through-hole 530. Further, the holes constituting the opening 23, including the pipe hole 63*b*, the hole in the housing 21, the hole in the outside thermal insulator 71, and the hole in the inside thermal insulator 72, may each have a different shape.

Figure 11:
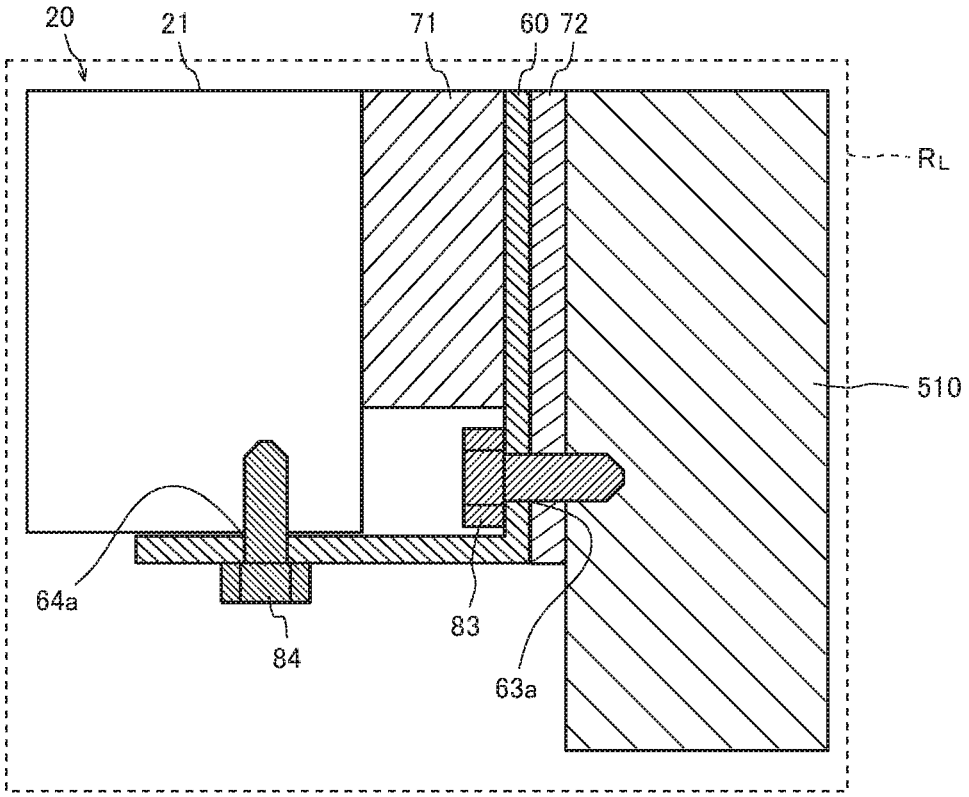
FIG. 11 illustrates a lower mounting area illustrated in FIG. 6 where a heat medium relay unit is mounted to an outer wall.

FIG. 11 illustrates a lower mounting area illustrated in FIG. 6 where the heat medium relay unit is mounted to the outer wall. With reference to FIG. 11, the following describes a specific structure of each component located within a lower mounting area $R_L$.

A lower portion of the mounting component 60 is bent at 90 degrees to extend parallel to the ground. In other words, as illustrated in FIG. 7 as well, the mounting component 60 has a lower portion with an L-shaped cross-section defined by the base part 63 and the support part 64. The mounting component 60 is fastened to the outer wall 510 with a screw 83 inserted through each screw hole 63*a* in the base part 63. The mounting component 60 is thus fixed more securely in place. The heat medium relay unit 20 is disposed such that the lower surface of the housing 21 faces the upper surface of the support part 64. The housing 21 is fastened to the mounting component 60 with a screw 84 inserted through each screw hole 64*a* in the support part 64.

As described above, the heat medium relay unit 20 is fixed to the outer wall 510 with the mounting component 60 interposed therebetween. This restricts the position of the heat medium relay unit 20 relative to the direction parallel to the ground, thus keeping the state in which the gap between the heat medium relay unit 20 and the mounting component 60 is filled with the outside thermal insulator 71. As a result, the heat medium within the heat medium pipes 51*a* and 51*b* can be prevented from being cooled by outdoor air and thus freezing.

As described above, with the air-conditioning apparatus 100 according to Embodiment, the heat medium relay unit 20 is installed to the outer wall 510 of a building. This makes it possible to reduce the entry of refrigerant into the indoor space when the intermediate heat exchanger 3 is damaged, and also prevent the heat medium pipe 51 from being exposed outdoors. As a result, leakage of refrigerant to the indoor space can be reduced, and also freezing of the heat medium flowing in the heat medium circuit 50 can be prevented.

The heat medium pipe 51 projects from the heat medium relay unit 20 through a side wall of the housing 21 facing the outer wall 510. In other words, the heat medium pipe 51 penetrates the side wall of the housing 21 and the outer wall 510. This makes it possible to avoid exposure of the heat medium pipe 51 to the outside air, thus preventing freezing of the heat medium. For instance, even if the heat medium relay unit 20 including the intermediate heat exchanger 3 is installed outdoors in a cold climate area, the above-mentioned configuration makes it possible to prevent the heat medium from freezing upon contact of the heat medium circuit 50 with outside air.

Further, the heat medium relay unit 20 includes the pressure relief device 6 disposed inside the heat medium relay unit 20 to discharge the heat medium out of the heat medium circuit 50 if the pressure within the heat medium circuit 50 rises to a pressure threshold. Consequently, any refrigerant entering the heat medium circuit 50 can be discharged outdoors from the pressure relief device 6 to ensure safety. Additionally, the heat medium relay unit 20 includes the ventilation fan 22 to send the air within the housing 21 to the outside. As a result, refrigerant discharged to the inside of the housing 21 from the pressure relief device 6 can be discharged outdoors more reliably, thus further increasing safety.

The air-conditioning apparatus 100 includes the mounting component 60 interposed between the housing 21 and the outer wall 510. The mounting component 60 has the projection 62 with the cutout 62*m* defined in an upper portion of the projection 62. The heat medium relay unit 20 is installed to the outer wall 510 by hooking the hook 25 into the cutout 62*m*. Therefore, with the mounting component 60, the heat medium relay unit 20 can be installed to the outer wall 510 in an easy and stable manner. In addition, the mounting component 60 has the base part 63 connected to the projection 62 and having the pipe hole 63*b* into which the heat medium pipe 51 is inserted. This allows for easy placement of the heat medium relay unit 20 with the heat medium pipe 51 projecting from its side wall, and also makes it possible to reduce the gap between the housing 21 and the outer wall 510. The mounting component 60 has the support part 64 connected to the base part 63 to support a lower portion of the housing 21. This allows for stable installation of the heat medium relay unit 20.

Further, the outside thermal insulator 71, which is a stretchable thermal insulator, is mounted to a surface of the base part 63 of the mounting component 60 that faces the heat medium relay unit 20. In the state before the heat medium relay unit 20 is installed to the outer wall 510, the outside thermal insulator 71 has a thickness larger than the projecting height H, which is the height of the projection 62 in the projecting direction Pd. This makes it possible to improve the thermal insulation of the heat medium pipe 51, and also prevent the entry of outdoor air into the heat medium relay unit 20, thus preventing freezing of the heat medium.

The inside thermal insulator 72, which is a stretchable thermal insulator, is mounted to a surface of the mounting component 60 facing the outer wall 510. This makes it possible to eliminate even a slight gap present between the mounting component 60 and the outer wall 510, thus preventing freezing of the heat medium within the heat medium pipe 51 with increased reliability. Further, vibrations generated from the refrigerant pipe 41, the heat medium pipe 51, and the intermediate heat exchanger 3 can be absorbed by the inside thermal insulator 72. This makes it possible to reduce propagation of vibration noise to the interior space.

The above-mentioned embodiment represents a specific preferred example of the air-conditioning apparatus, and the technical scope of the present disclosure is not limited to the details described herein. For example, although FIGS. 7 and 8 illustrate an exemplary case in which the projection 62 has a U-shaped cross-section, this is not intended to be restrictive. Alternatively, the projection 62 may be a cuboid component. In this case, the surface on the upper side of the projection 62 may be provided with a groove serving as the cutout 62*m* into which the hook 25 is to be hooked. The projection 62 and the housing 21 may be fixed to each other by using a fixing component such as a screw, such as by providing a screw hole in the projection 62.

Although the foregoing description is directed to an exemplary case in which the fixing part 61 has two screw holes 61*a*, the base part 63 has two screw holes 63*a*, and the support part 64 has two screw holes 64*a*, this is not intended to be limiting. Each of the fixing part 61, the base part 63, and the support part 64 may have a single screw hole, or three or more screw holes. That is, the support part 64 has at least one screw hole 64*a*, and the housing 21 is fastened to the mounting component 60 with the screw 84 inserted through the screw hole 64*a*. This configuration allows for more stable installation of the heat medium relay unit 20. It is to be noted, however, that the number of screw holes 61*a*, the number of screw holes 63*a*, and the number of screw holes 64*a* may differ from each other.

Although the above-mentioned embodiment is directed to an exemplary case in which the mounting component 60 has the base part 63 and the support part 64, this is not intended to be restrictive. Alternatively, the mounting component 60 may not have the base part 63 and the support part 64. In this case, if the outside thermal insulator 71 is mounted to a surface of the housing 21 facing the outer wall 510, the gap between the housing 21 and the outer wall 510 is filled with the outside thermal insulator 71. This makes it possible to prevent the entry of outside air into the heat medium relay unit 20, and also improve the thermal insulation of the heat medium pipe 51. It is to be noted, however, that providing the mounting component 60 with the base part 63 makes it possible to mount the mounting component 60 to the outer wall 510 in a more stable manner than is otherwise possible. Further, providing the mounting component 60 with the support part 64 makes it possible to hold the intermediate heat exchanger 3 in a more stable manner than providing without the support part 64.

Further, although the above-mentioned embodiment is directed to a case in which the heat medium relay unit 20 and the mounting component 60 are separate components, this is not intended to be restrictive. For example, the mounting component 60 may be formed integrally with the housing 21. In this case, the heat medium relay unit 20 formed integrally with the mounting component 60 is preferably disposed with the mounting component 60 facing the outer wall 510, and is then fixed to the outer wall 510 with a fixing component such as a screw. This makes it possible to prevent the outside thermal insulator 71 affixed on the mounting component 60 from coming off during installation of the heat medium relay unit 20.

In addition, although the foregoing description is directed to an exemplary case in which the outside thermal insulator 71 and the inside thermal insulator 72 are mounted to the mounting component 60, this is not intended to be limiting. Alternatively, the outside thermal insulator 71 may be mounted to the housing 21, and the inside thermal insulator 72 may be mounted to the outer wall 510.

Although the foregoing description is directed to an exemplary case in which the mounting component 60 is interposed between the heat medium relay unit 20 and the outer wall 510, and the heat medium relay unit 20 is located in proximity to the outer wall 510, this is not intended to be limiting. Alternatively, the heat medium relay unit 20 may be disposed in contact with the outer wall 510. For example, with the housing 21 being placed in contact with the outer wall 510, upper and lower portions of the housing 21 may be fixed to the outer wall 510 by using a component such as a metal fitting with an L-shaped cross-section.

The invention claimed is:

1. An air-conditioning apparatus, comprising:

an outdoor unit installed in an outdoor space, the outdoor unit including a heat-source heat exchanger configured to exchange heat between outside air and refrigerant, the outdoor space being a space outside a building including an air-conditioned space;

a heat medium relay unit installed in the outdoor space, the heat medium relay unit including an intermediate heat exchanger and a housing, the intermediate heat exchanger being configured to exchange heat between a heat medium and the refrigerant, the housing being configured to accommodate the intermediate heat exchanger; and an indoor unit including a load heat exchanger configured to exchange heat between air in the air-conditioned space and the heat medium, wherein the housing is installed to an outer wall of the building, wherein the intermediate heat exchanger and the load heat exchanger are connected by a heat medium pipe to form a heat medium circuit in which the heat medium circulates, wherein the heat medium pipe projects from the heat medium relay unit through a side wall of the housing facing the outer wall, and wherein the heat medium relay unit includes a pressure relief device disposed inside the housing, the pressure relief device being configured to discharge the heat medium out of the heat medium circuit when a pressure within the heat medium circuit rises to a pressure threshold, wherein the air-conditioning apparatus further comprises a mounting component interposed between the housing and the outer wall, wherein the mounting component has a fixing plate fixed to the outer wall, and a projection connected to the fixing plate, the projection having a cutout defined in an upper portion of the projection, wherein the housing has a hook, the hook having a shape corresponding to the cutout, and wherein the heat medium relay unit is installed to the outer wall by hooking the hook into the cutout, and wherein the projection extends across an entire width of the fixing plate and has a U-shaped cross section when viewed from a direction parallel to the outer wall.

2. The air-conditioning apparatus of claim 1, wherein the heat medium relay unit includes a ventilation fan configured to send air within the housing to an outside.

3. The air-conditioning apparatus of claim 1, wherein the mounting component has a base plate connected to the projection, the base plate having a pipe hole into which the heat medium pipe is inserted.

4. The air-conditioning apparatus of claim 3, wherein the mounting component has a support plate, the support plate being connected to the base plate to support a lower portion of the housing.

5. An air-conditioning apparatus, comprising:

an outdoor unit installed in an outdoor space, the outdoor unit including a heat-source heat exchanger configured to exchange heat between outside air and refrigerant, the outdoor space being a space outside a building including an air-conditioned space;

a heat medium relay unit installed in the outdoor space, the heat medium relay unit including an intermediate heat exchanger and a housing, the intermediate heat exchanger being configured to exchange heat between a heat medium and the refrigerant, the housing being configured to accommodate the intermediate heat exchanger; and an indoor unit including a load heat exchanger configured to exchange heat between air in the air-conditioned space and the heat medium, wherein the housing is installed to an outer wall of the building, wherein the intermediate heat exchanger and the load heat exchanger are connected by a heat medium pipe to form a heat medium circuit in which the heat medium circulates, wherein the heat medium pipe projects from the heat medium relay unit through a side wall of the housing facing the outer wall, wherein the air-conditioning apparatus further comprises a mounting component interposed between the housing and the outer wall, wherein the mounting component has a fixing plate fixed to the outer wall, and a projection connected to the fixing plate, the projection having a cutout defined in an upper portion of the projection, wherein the housing has a hook, the hook having a shape corresponding to the cutout, wherein the heat medium relay unit is installed to the outer wall by hooking the hook into the cutout, wherein the mounting component has a base plate connected to the projection, the base plate having a pipe hole into which the heat medium pipe is inserted, wherein the mounting component has a support plate, the support plate being connected to the base plate to support a lower portion of the housing, wherein the support plate has at least one screw hole, and wherein the housing is fastened to the mounting component with a screw inserted through the screw hole.

6. An air-conditioning apparatus, comprising:

an outdoor unit installed in an outdoor space, the outdoor unit including a heat-source heat exchanger configured to exchange heat between outside air and refrigerant, the outdoor space being a space outside a building including an air-conditioned space;

a heat medium relay unit installed in the outdoor space, the heat medium relay unit including an intermediate heat exchanger and a housing, the intermediate heat exchanger being configured to exchange heat between a heat medium and the refrigerant, the housing being configured to accommodate the intermediate heat exchanger; and an indoor unit including a load heat exchanger configured to exchange heat between air in the air-conditioned space and the heat medium, wherein the housing is installed to an outer wall of the building, wherein the intermediate heat exchanger and the load heat exchanger are connected by a heat medium pipe to form a heat medium circuit in which the heat medium circulates, wherein the heat medium pipe projects from the heat medium relay unit through a side wall of the housing facing the outer wall, wherein the air-conditioning apparatus further comprises a mounting component interposed between the housing and the outer wall, wherein the mounting component has a fixing plate fixed to the outer wall, and a projection connected to the fixing plate, the projection having a cutout defined in an upper portion of the projection, wherein the housing has a hook, the hook having a shape corresponding to the cutout, and wherein the heat medium relay unit is installed to the outer wall by hooking the hook into the cutout, wherein the mounting component has a base plate connected to the projection, the base plate having a pipe hole into which the heat medium pipe is inserted, wherein an outside thermal insulator is mounted to a surface of the base plate of the mounting component, the outside thermal insulator being a stretchable thermal insulator, the surface facing the heat medium relay unit, and wherein in a state before the heat medium relay unit is installed to the outer wall, the outside thermal insulator has a thickness larger than a projecting height, the projecting height being a height of the projection in a direction in which the projection projects.

7. The air-conditioning apparatus of claim 1, wherein an inside thermal insulator is mounted to a surface of the mounting component facing the outer wall, the inside thermal insulator being a stretchable thermal insulator.

8. The air-conditioning apparatus of claim 5, wherein the heat medium relay unit includes a ventilation fan configured to send air within the housing to an outside.

9. The air-conditioning apparatus of claim 5, wherein an outside thermal insulator is mounted to a surface of the base plate of the mounting component, the outside thermal insulator being a stretchable thermal insulator, the surface facing the heat medium relay unit, and wherein in a state before the heat medium relay unit is installed to the outer wall, the outside thermal insulator has a thickness larger than a projecting height, the projecting height being a height of the projection in a direction in which the projection projects.

10. The air-conditioning apparatus of claim 5, wherein an inside thermal insulator is mounted to a surface of the mounting component facing the outer wall, the inside thermal insulator being a stretchable thermal insulator.

11. The air-conditioning apparatus of claim 6, wherein the heat medium relay unit includes a ventilation fan configured to send air within the housing to an outside.

12. The air-conditioning apparatus of claim 6, wherein the mounting component has a support plate, the support plate being connected to the base plate to support a lower portion of the housing.

13. The air-conditioning apparatus of claim 12, wherein the support plate has at least one screw hole, and wherein the housing is fastened to the mounting component with a screw inserted through the screw hole.

14. The air-conditioning apparatus of claim 6, wherein an inside thermal insulator is mounted to a surface of the mounting component facing the outer wall, the inside thermal insulator being a stretchable thermal insulator.

* * * * *